US005943853A

United States Patent [19]

Stahlecker

[11] Patent Number: 5,943,853

[45] Date of Patent: Aug. 31, 1999

[54] OPEN-END SPINNING MACHINE WITH A TRASH REMOVAL SYSTEM

[75] Inventor: Gerd Stahlecker, Eislingen, Germany

[73] Assignee: Novibra GmbH, Suessen, Germany

[21] Appl. No.: 08/964,759

[22] Filed: Nov. 5, 1997

[30] Foreign Application Priority Data

Dec. 17, 1996 [DE] Germany ..... 196 52 506

[51] Int. Cl.[6] ..... D01H 11/00

[52] U.S. Cl. ..... 57/301; 57/303; 57/304; 57/408; 57/411

[58] Field of Search ..... 57/300, 301, 304, 57/306, 408, 411, 412

[56] References Cited

U.S. PATENT DOCUMENTS 4,183,201 1/1980 Stahlecker ..... 57/301

*Primary Examiner*—William Stryjewski

*Attorney, Agent, or Firm*—Evenson McKeown Edwards and Lenahan, PLLC

[57] ABSTRACT

The adjacently arranged spinning aggregates of an open-end spinning machine are each provided with an opening device, which includes a removal opening for trash particles. A channel extending in the machine longitudinal direction takes up the trash particles. A sliding carriage traverses in the channel, which sliding carriage is coupled to a belt-like traction mechanism and which pushes the gathered trash particles ahead of itself to a suction point. The channel is wider than the distribution area of the trash particles in this direction. A clearance area occurs hereby in the channel, in which the traction mechanism extends.

20 Claims, 5 Drawing Sheets

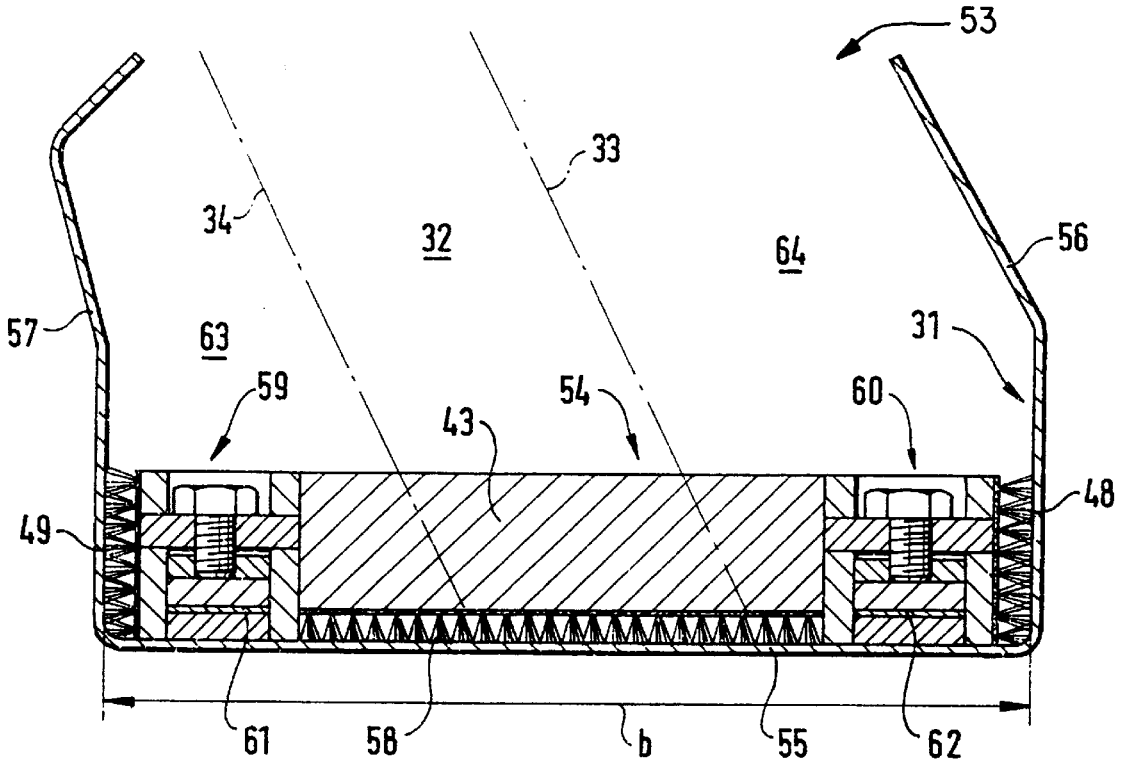
FIG. 5
FIG. 6
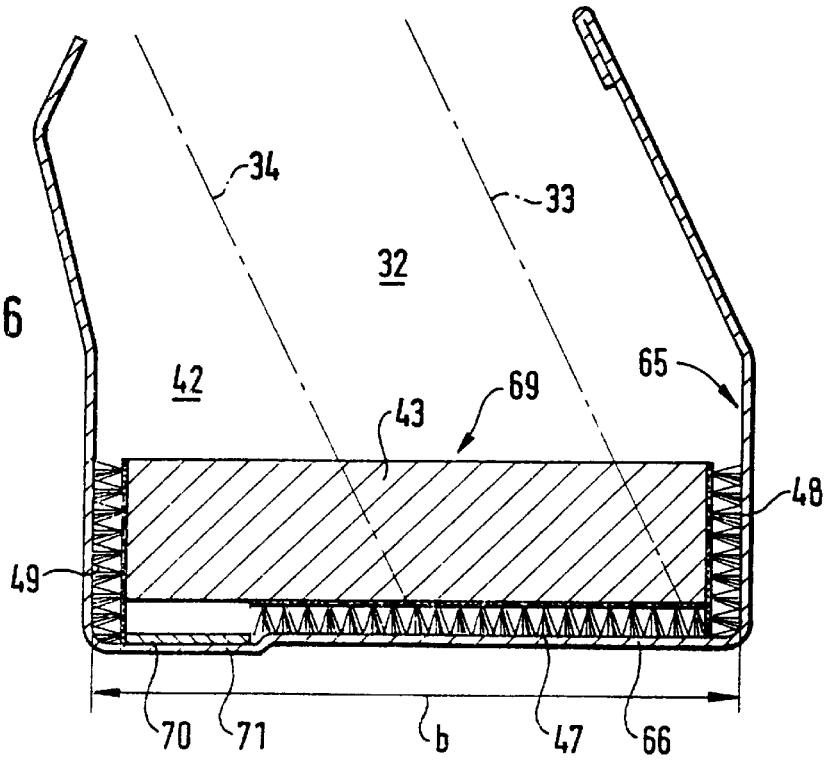

OPEN-END SPINNING MACHINE WITH A TRASH REMOVAL SYSTEM

BACKGROUND AND SUMMARY OF THE INVENTION

This application claims the priority of German application 196 52 505.3 filed in Germany on Dec. 17, 1996, the disclosure of which is expressly incorporated by reference herein.

The present invention relates to an open-end spinning machine comprising a plurality of adjacently arranged spinning aggregates, which each comprise an opening device with a removal opening, under which a channel is arranged extending the entire length of the machine for the purpose of taking up expelled trash particles, which fall onto said channel over a distribution area of the trash particles and in which channel a sliding carriage traverses while pushing the collected trash particles ahead of itself to a suction point, the sliding carriage being coupled to at least one belt-like traction mechanism.

In the case of an open-end spinning machine of this type (U.S. Pat. No. 4,183,201), the distribution area of the trash particles corresponds—transversely to the longitudinal direction of the machine—to the width of the channel. Thus the belt-like traction mechanism moves inside of the distribution area and is covered by trash particles. It is not apparent from the above mentioned publication how the trash particles adhering to the traction mechanism are removed therefrom.

It is an object of the present invention to avoid this disadvantage of the prior art and to keep the traction mechanism to a large extent free of trash particles.

This object has been achieved according to the present invention in that the width of the channel extends beyond the area of distribution and thus forms a clearance area, free to a large extent of expelled trash particles, in which clearance area the traction mechanism extends.

As the channel for transporting the trash particles away is located underneath the spinning aggregates, there are practically no limits with regards to the extension of the width of the channel as there is sufficient space available. As the traction mechanism is, to a large extent, free of trash particles, the sucking off thereof at the suction points, preferably at the end of the machine, is facilitated. Nevertheless, the channel is cleaned at the suction points not only inside the distribution area, but over its entire width.

In an embodiment of the present invention, clearance areas can be present on both sides of the distribution area, in each of which a traction mechanism extends. Due to the symmetrical application of force of the two traction mechanisms, the sliding carriage cannot tilt inside the channel.

In another embodiment of the present invention, only one clearance area may be present beside the distribution area, in which a traction mechanism extends eccentric to the sliding carriage. This means less expenditure for the drive, but it is often necessary to provide the sliding carriage with guiding devices in order to prevent it from tilting. As a rule, however, tilting is avoided in that the sliding carriage is a good deal longer than it is wide.

The opening devices advantageously comprise opening rollers, whose axles extend transversely to the length of the machine, whereby the distribution area is essentially limited to the effective width of the opening roller. This results not only in a narrower distribution area, but also in that the distribution area is clearly defined with regard to its width. If the axles of the opening rollers extended parallel to the channel as in the above mentioned prior art, then the distribution area of the trash particles in transverse direction to the machine would not only be larger, but also relatively vague.

In a further embodiment of the present invention, the sliding carriage is provided with a coupling device—applied in the at least one clearance area—for being coupled to the traction mechanism. The coupling device is thus disposed in the clearance area and remains as a consequence to a large extent free of trash particles.

The belt-like traction mechanism is advantageously a steel belt measuring only 0.1 to 0.2 mm in thickness, so that the channel has a plane bottom. Should a textile traction mechanism be used, which would naturally be thicker than a steel belt, then it is advantageous that a recess in the bottom of the channel is provided in the clearance area, the depth of the recess being adapted to the thickness of the traction mechanism. Thus a plane bottom of the channel is created for a thicker traction belt.

BRIEF DESCRIPTION OF THE DRAWINGS

These and further objects, features and advantages of the present invention will become more readily apparent from the following detailed description thereof when taken in conjunction with the accompanying drawings wherein:

FIG. 5 is a view similar to FIG. 2 depicting a further embodiment of the invention and showing however only the area of the channel, whereby two belt-like traction mechanisms are arranged at the sliding carriage;

FIG. 6 is a view similar to FIG. 5 depicting a further embodiment of the invention with a thicker belt-like traction mechanism, at which a recess in the bottom of the channel is arranged;

DETAILED DESCRIPTION OF THE DRAWINGS

Figure 1:
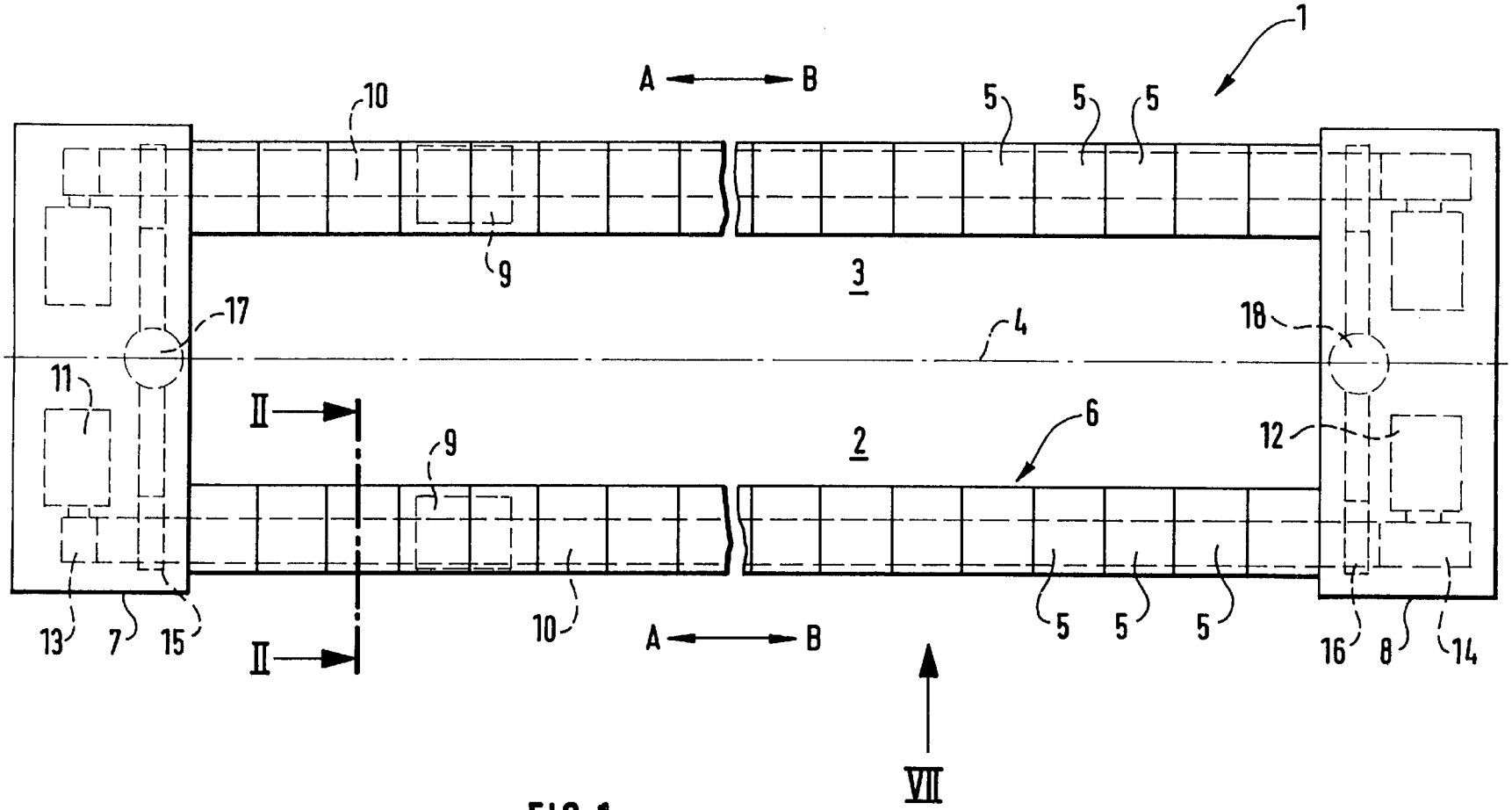
FIG. 1 is a top view of an open-end spinning machine only schematically shown, which comprises on both machine sides a plurality of adjacently arranged spinning aggregates, constructed according to a preferred embodiment of the present invention.

The open-end spinning machine 1 as shown in FIG. 1 comprises two machine sides 2 and 3, which extend symmetrically to the central longitudinal plane 4 and each comprise a plurality of spinning aggregates 5 adjacently arranged in a row 6. The spinning aggregates 5 are here only schematically denoted by rectangles and comprise normally a feed and opening device for a sliver to be opened into single fibers, and also a twist device for spinning the single fibers to a yarn. At both ends of the open-end spinning machine 1, a so-called headstock 7 or 8 is arranged, in which the drive and gear devices of the open-end spinning machine 1, as well as other aggregates, are housed.

Underneath the spinning aggregates 5, a sliding carriage 9 extends on each machine side 2 and 3 in a longitudinal direction of the machine. The function and form of the sliding carriage 9 is described in detail below. Each of the sliding carriages 9 is coupled with a traction mechanism 10, which can, for example, be made of a very thin steel belt. Drive motors 11 and 12 located inside the headstocks 7 and 8 are arranged at the two traction mechanisms 10; the way these motors 11 and 12 function is described below in more detail. Due to the drive of these drive motors 11 and 12, the traction mechanisms 10 are moved from side to side in the traverse directions A and B.

On each drive shaft of the drive motors 11 and 12, winding discs 13 or 14 are disposed, onto which the belt-like traction mechanism 10 is alternately temporarily wound during its traverse movements. This procedural step is described below. Suction points 15 and 16 are located in the headstocks 7 and 8 in proximity to the winding discs 13 and 14, which suction points 15 and 16 are connected to a vacuum source 17 or 18 and serve to clean the sliding carriage 9 and the traction mechanism 10.

Figure 2:
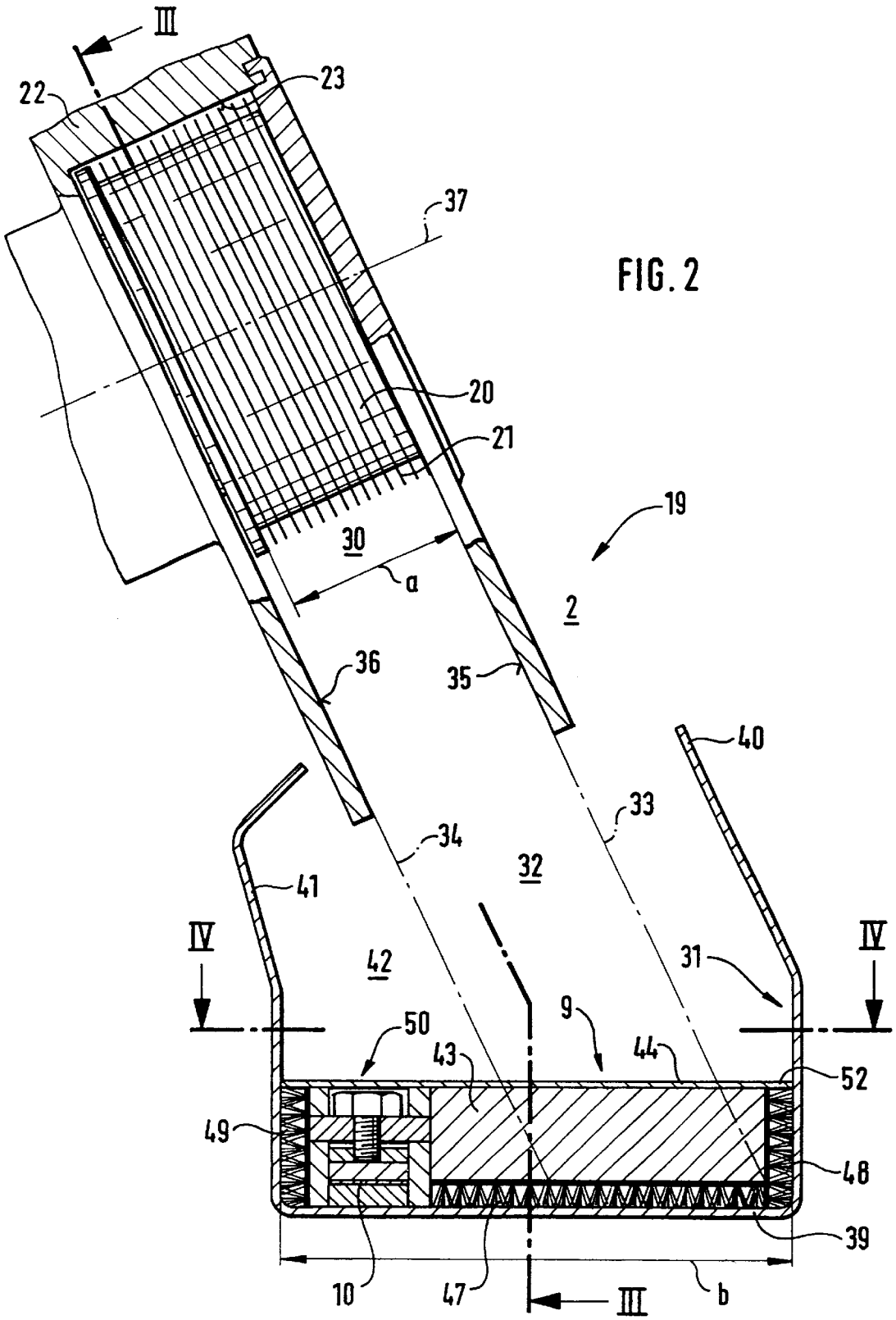
FIG. 2 is in enlarged form a section cut along the intersection line II—II of FIG. 1 in the area of an opening device and the channel arranged thereto for carrying away trash particles.
Figure 3:
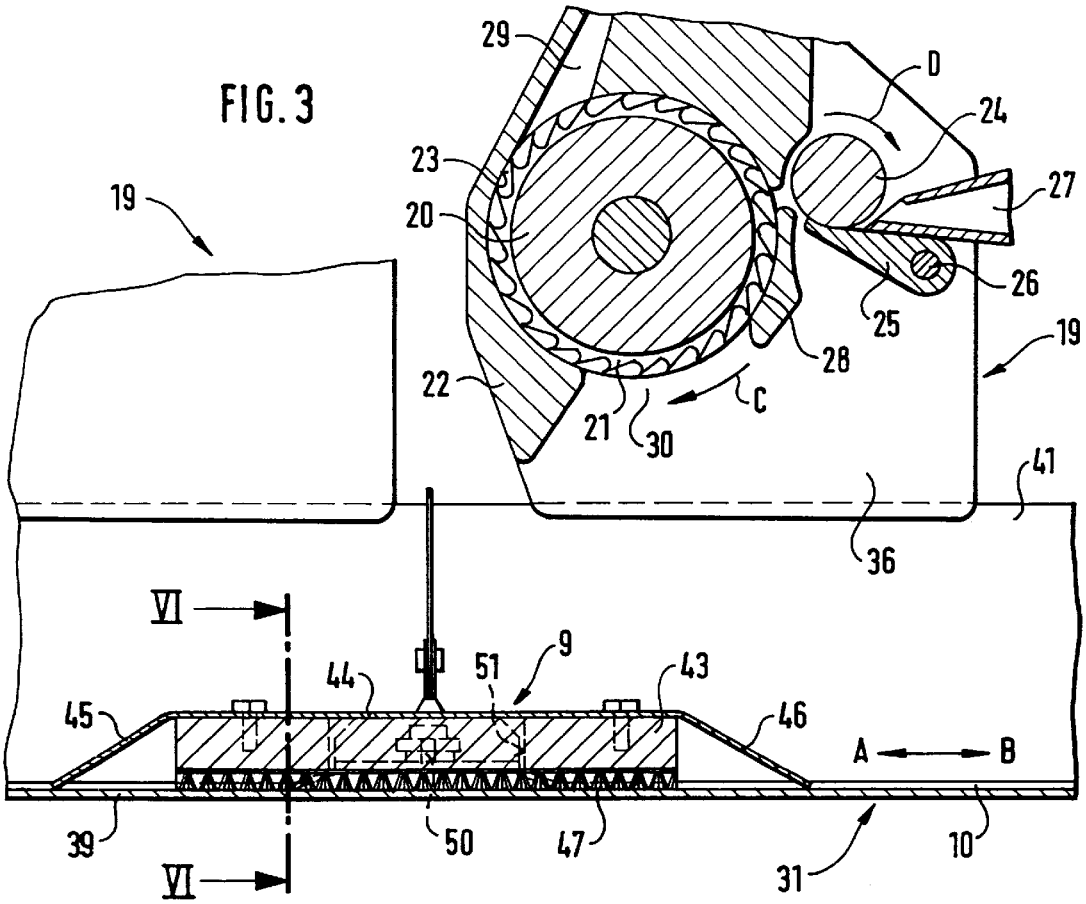
FIG. 3 is a cross section along the intersection line III—III of FIG. 2, in slightly reduced scale.
Figure 4:
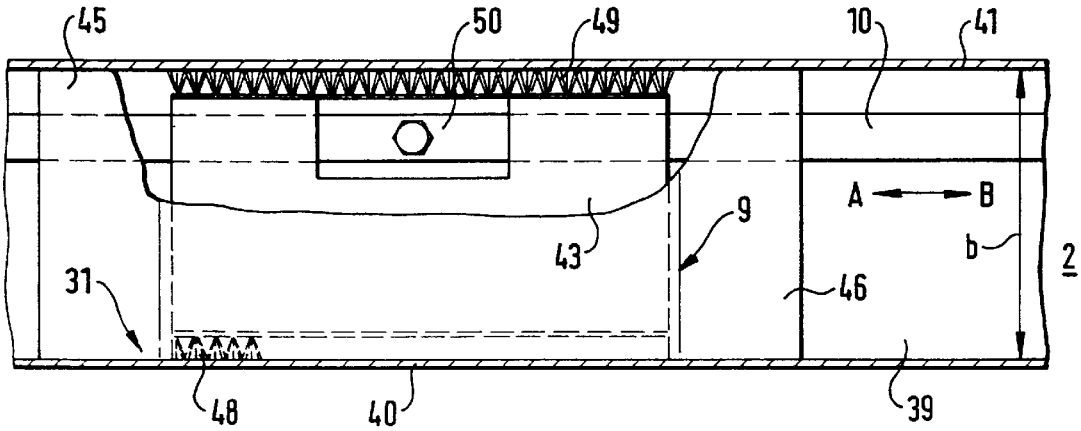
FIG. 4 is a cross section along the section plane IV—IV of FIG. 3 in the area of the sliding carriage which removes the trash particles.

The present invention proper is described in more detail with the aid of the FIGS. 2, 3 and 4.

The opening devices 19 of the individual spinning aggregates 5 each comprise an opening roller 20, which rotates in rotational direction C. The opening roller 20 is provided on its circumference in a known way with a needle or saw-tooth-like combing structure 21, which has an effective width a. The opening roller 20 rotates in a housing 22, which surrounds the periphery of the combing structure 21 to a large extent with guiding surfaces 23.

A feed roller 24 is arranged upstream of the opening roller 20, which feed roller 24 rotates in rotational direction D, but at a significantly lower speed than the opening roller 20. A feed table 25 is arranged at the feed roller 24, which feed table 25 can be swivelled around a swivel axle 26 under the action of a loading spring (not shown) and pressed from below to the feed roller 24, whereby a nipping line for a fed sliver (not shown) arises. The sliver is fed to the feed roller 24 by means of a feed condenser 27.

Downstream of the above mentioned nipping line, the feed roller 24 feeds the end of the sliver, the so-called fiber beard, to the combing structure 21 of the opening roller 20. The fiber beard is opened to single fibers in a known way by means of the combing means 21, which single fibers then follow the rotational direction C and are fed by means of fiber feed channel 29 to a twist device (not shown), for example a spinning rotor. The fiber feed channel 29 is subject to a vacuum for this purpose.

In order that the fiber beard is opened to single fibers more easily, a stationary fiber beard support 28 adjoins the feed roller 24, which fiber beard support 28 presses the fiber beard from the back side into the combing structure 21.

A removal opening 30 for trash particles is located between the fiber beard support 28 and the guiding surface 23 which precedes the fiber feed channel 29, which trash particles are forced out during the transport of the single fibers by the combing structure 21 and are removed through the removal opening 30. The lighter single fibers however, follow the combing structure 21 to the fiber feed channel 29.

The expelled trash particles fall in a channel 31 which extends in machine longitudinal direction and which is U-shaped in cross section, whereby the opening faces the opening roller 20. The channel 31 has a width b transverse to the longitudinal direction of the machine; the significance of this width b is described below.

The trash particles expelled from the combing structure 21 fall onto the channel 31 over a distribution area 32, which is denoted in FIG. 2 by two dot-dash bordering lines 33 and 34. These bordering lines 33 and 34 are the imaginary extension of corresponding guiding surfaces 35 and 36 of the housing 22. The distribution area 32 of the trash particles corresponds approximately to the effective width a of the combing structure 21 and to a large extent the clearance between the two guiding surfaces 35 and 36. The almost exact determining of the distribution area 32 is made possible in that the axle 37 of the opening roller 20 extends transversely to the machine longitudinal direction and thus transversely to the channel 31. Thus it can be fairly exactly calculated over which area the trash particles will land on the bottom 39 of the channel 31, or if it be the case, on the one side wall 40 of the channel 31 facing the tending side. The other side wall 41 of the channel 32 facing the machine interior remains practically free of trash particles.

Between the distribution area 32 extending transversely to the front side of the open-end spinning machine 1 and the side wall 41 facing the machine interior, a clearance area 42 occurs, which remains to a large extend free from trash particles. This clearance area 42 is made possible in that the width b of the channel 31 is significantly larger than the distribution area 32. According to the present invention, the belt-like traction mechanism 10 is arranged in this clearance area 42, which traction mechanism 10 remains thus to a large extend free of trash particles and can, if at all necessary, be relatively easily cleaned at the machine ends. As can be seen from FIG. 2, the traction mechanism 10 in this embodiment extends eccentrically to the sliding carriage 9.

The sliding carriage 9 comprises a base body 43, whose weight is such that the sliding carriage 9 is always disposed on the bottom 39 of the channel 31. Except for a small recess 51, which is described below, the base body 43 essentially takes up the entire width b of the channel 31. T he base body 43 is covered by a cover plate 44. The cover plate 44 is longer in traverse direction A and B than the base body 43 and is guided in both directions with a bevel 45 or 46 to the bottom 39 of the channel 31. Thus the cover plate 44 has in this area the function of a scraper.

The base body 43 is provided with brushes 47, 48 and 49 towards the bottom 39 and the side walls 40 and 41, which brushes 47, 48 and 49 leave free a lateral recess 51, in which the coupling mechanism 50 for coupling the sliding carriage 9 to the belt-like traction mechanism 10 are provided, see in particular FIG. 4. The entire bottom 39 of the base body 43 outside of the coupling mechanism 50 is thus equipped with the bristles of a brush 47.

The coupling mechanism 50, whose form is to a large extent shown in FIG. 2, is constructed as a clamping device, so that the coupling mechanism 50 is clamped by means of a clamping screw to the belt-like traction mechanism 10. Outside of the clamping mechanism 50, the belt-like traction mechanism 10 is disposed on the bottom 39 of the channel 31, however,—as already described—inside of the clearance 42. Due to the recess 51, the base body 43, together with the cover plate 44, can be raised from the coupling mechanism 50 and thus be removed in a simple way from the traction mechanism 10 for maintenance purposes. The coupling mechanism 50, in contrast, remain as a rule securely connected with the traction mechanism 10.

The cover plate 44 is provided towards the side walls 40 and 41 with guiding devices 52, which prevent the sliding carriage 9 from tilting. These guiding devices 52 are practical, as the belt-like traction mechanism 10 acts eccentrically on the sliding carriage 9.

In the embodiment of the present invention shown in FIG. 5, a channel 53 is provided, whose width b is larger than the previous embodiment. The distribution area 32, which is again denoted by bordering lines 33 and 34, is here so defined that on both sides of the distribution area 32, clearance areas 63 and 64 remain inside of the channel 53. This permits a belt-like traction mechanism 61 and 62 to be applied to a sliding carriage 54 on both sides of the distribution area 32 and thus to ensure a symmetrical drive of the sliding carriage 54. There is thus no risk that the sliding carriage 54, gliding over the bottom 55 of the channel 53, tilts at the side walls 56 and 57 of the channel 53. The sliding carriage 54 can thus be made shorter overall.

Because of the two belt-like traction mechanisms 61 and 62, coupling mechanisms 59 and 60 are necessary on both sides of the distribution area 32 in the case of this embodiment, which coupling mechanism 59 and 60 are formed as described above in connection with coupling mechanisms 50 of FIGS. 1–4.

In the embodiment of the present invention as shown in FIG. 6, again only one clearance area 42 is provided, however this time for a belt-like traction mechanism 70 which consists not of a very thin steel belt, but rather of a relatively thick textile belt. For this reason, a recess 71 is provided in the bottom 66 of the somewhat differently formed channel 65, the depth of which recess 71 corresponds approximately to the thickness of the textile traction mechanism 70. The sliding carriage 69 can, in this embodiment, correspond to a large extent to the embodiments in FIGS. 2 to 4. A repeat description can thus be omitted. Due to the trough-like recess 71, the bottom 66 forms together with the upper side of the traction mechanism 70 a largely plane surface.

Figure 7:
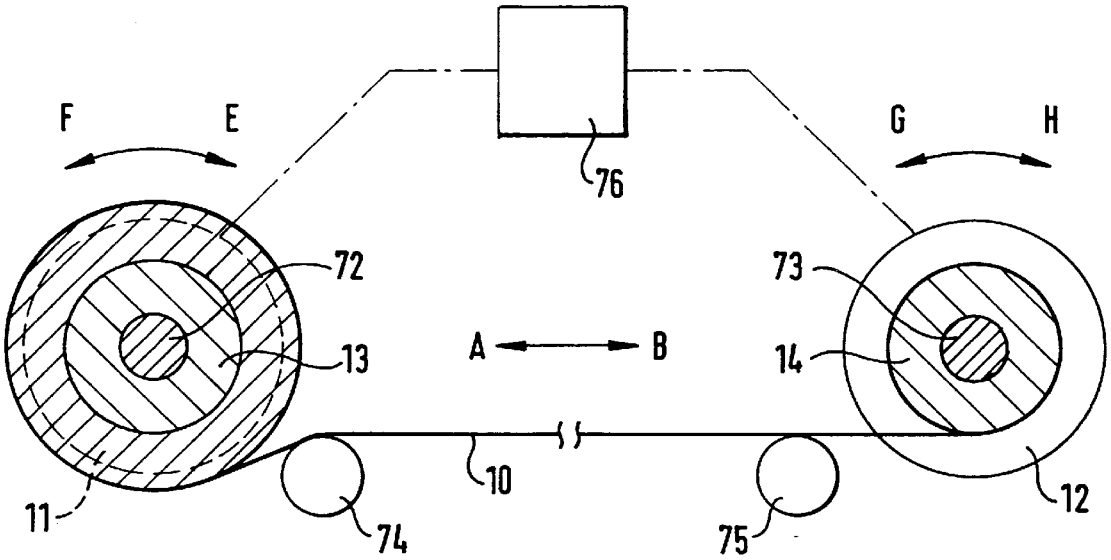
FIG. 7 is an enlarged part view in the direction of the arrow VII of FIG. 1 to illustrate the drive of the traction mechanism.

As the belt-like traction mechanism 10 is wound during its traverse motion according to the traverse directions A and B alternately onto the winding discs 13 and 14 mentioned above, it is practical when a particularly thin steel belt of, for example, 0.1 mm thickness is used. This is shown schematically in FIG. 7. The drive shafts 72 and 73 of the two drive motors 11 and 12 are recognizable, whereby the sliding carriage, not shown in FIG. 7, is located at this time in proximity to the drive motor 11. For this reason, the winding disc 13 is fuller with the traction mechanism 10 than the other winding disc 14, which is almost empty. When the sliding carriage 9 (not shown) travels back in traverse direction B to the headstock 8, the winding disc 13 is emptied and the winding disc 14 is filled with the belt-like traction mechanism 10.

As soon as the sliding carriage 9 arrives at the headstock 7 or 8, the two drive motors 11 and 12 change their rotational direction, so that the drive motor 11 switches over from the rotational direction E to F and the drive motor 12 switches over from the rotational direction G to H. Both drive motors 11 and 12 are connected for this purpose to a control system 76, which controls the switching over accordingly. Due to the different degrees of fullness of the winding discs 13 and 14, guiding pulleys 74 and 75 are provided in the area of the winding discs 13 and 14, which guiding pulleys 74 and 75 are arranged in such a way that the belt-like traction mechanism 10 is constantly disposed on the bottom 39 of the respective channel 31.

Figure 8:
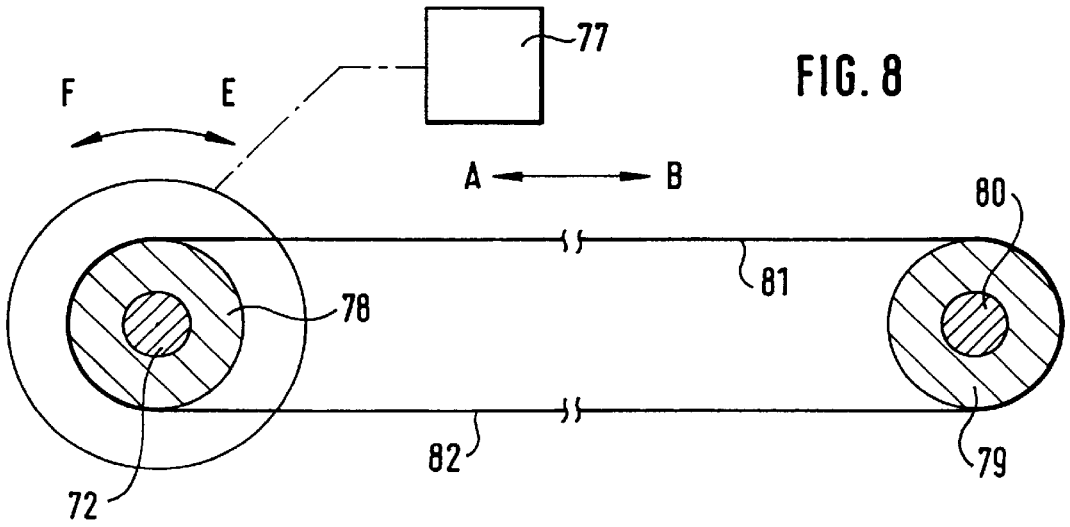
FIG. 8 is a view similar to FIG. 7 of another embodiment of the drive of the traction mechanism.

If a thicker belt-like traction mechanism 10 is to be used, then it is no longer purposeful to wind the traction mechanism 10 alternately onto winding discs at the respective headstocks 7 and 8. In this case, as shown in FIG. 8, an endless belt-like traction mechanism 81 is used, which is driven to perform traverse motions according to the traverse directions A and B. In this embodiment of the present invention, only one drive motor 11 is required, which can be switched over to the traverse rotational directions E and F by a control system 77. At the other machine end, only a tension disc 79 is required, which serves as a deflecting disc and whose axle 80 is adjustable is such a way that the belt-like traction mechanism 81 can be tensioned.

In the embodiment of the present invention according to FIG. 8, it is, however, necessary that underneath the channel 31 a second bottom plate is present, on which the loose end 82 of the belt-like traction mechanism 81 is disposed and guided.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An open-end spinning machine comprising a plurality of spinning aggregates arranged adjacently in a row, which spinning aggregates each comprise an opening device having a removal opening, under which a continuous channel extends in a spinning machine longitudinal direction for taking up expelled trash particles, which fall onto said continuous channel over a distribution area of the trash particles and in which channel a sliding carriage traverses and pushes the collected trash particles ahead of itself to a suction point, which sliding carriage is coupled to at least one belt-like traction mechanism, wherein the width of the channel extends beyond the distribution area and thus forms at least one clearance area which is to a large extent free of trash particles, and in which at least one clearance area the traction mechanism extends, and wherein the opening devices comprise opening rollers, whose axles extend transversely to the longitudinal direction of the machine and wherein consequently the distribution area is essentially limited to the effective width of the opening rollers.

2. An open-end spinning machine according to claim 1, wherein the sliding carriage is provided with coupling means applied in the at least one clearance area for coupling to the traction mechanism.

3. An open-end spinning machine according to claim 1, wherein a channel is provided in at least one of the clearance areas with a recess intended for the traction mechanism.

4. An open-end spinning machine according to claim 1, wherein the at least one clearance area includes respective clearance areas on both sides of the distribution area, and wherein a plurality of traction mechanisms are provided, one of said traction mechanisms extending in each of said clearance areas at the respective sides of the distribution area.

5. An open-end spinning machine according to claim 1, wherein the at least one clearance area includes a clearance area on one side adjacent to the distribution area, in which clearance area the traction mechanism extends eccentrically to the sliding carriage.

6. An open-end spinning machine according to claim 5, wherein the sliding carriage is provided with guiding devices for prevent the sliding carriage from tilting.

7. An open-end spinning machine according to claim 6, wherein the channel includes a recess for accommodating the traction mechanism.

8. An open-end spinning machine according to claim 1, wherein the sliding carriage is provided with guiding devices for prevent the sliding carriage from tilting.

9. An open-end spinning machine according to claim 1, wherein the channel includes a recess for accommodating the traction mechanism.

10. A trash removal system for removing trash particles from adjacently arranged sliver opening devices of an open-end spinning machine, comprising:

a continuous channel extending under a plurality of opening devices, said continuous channel having a width greater than respective trash distribution area openings of said opening devices to thereby form at least one substantially trash free clearance area, a sliding carriage disposed in said channel and serving to push trash particles falling into said channel to a trash removal suction point disposed along a travel path of the sliding carriage, a traction mechanism disposed in said channel and coupled to the sliding carriage and disposed in said trash free clearance area laterally of trash distribution areas under said trash distribution area openings, wherein respective ones of said trash free clearance areas are disposed at both lateral sides of said trash distribution area openings, and wherein a traction mechanism for said sliding carriage is disposed in each of said trash free clearance areas.

11. A trash removal system for removing trash particles from adjacently arranged sliver opening devices of an open-end spinning machine, comprising:

a continuous channel extending under a plurality of opening devices, said continuous channel having a width greater than respective trash distribution area openings of said opening devices to thereby form at least one substantially trash free clearance area, a sliding carriage disposed in said channel and serving to push trash particles falling into said channel to a trash removal suction point disposed along a travel path of the sliding carriage, and a traction mechanism disposed in said channel and coupled to the sliding carriage and disposed in said trash free clearance area laterally of trash distribution areas under said trash distribution area openings, wherein the at least one clearance area includes respective clearance areas on both sides of the distribution area, and wherein a plurality of traction mechanisms are provided, one of said traction mechanisms extending in each of said clearance areas at the respective sides of the distribution area.

12. A trash removal system according to claim 11, wherein the sliding carriage is provided with guiding devices for preventing the sliding carriage from tilting.

13. A trash removal system according to claim 11, wherein the opening devices comprise opening rollers, whose axles extend transversely to the longitudinal direction of the machine and wherein consequently the distribution area is essentially limited to the effective width of the opening roller.

14. A trash removal system according to claim 13, wherein the sliding carriage is provided with coupling means applied in the at least one clearance area for coupling to the traction mechanism.

15. A trash removal system according to claim 11, wherein a recess intended for the traction mechanism is provided in the channel.

16. A trash removal system for removing trash particles from adjacently arranged sliver opening devices of an open-end spinning machine, comprising:

a continuous channel extending under a plurality of opening devices, said continuous channel having a width greater than respective trash distribution area openings of said opening devices to thereby form at least one substantially trash free clearance area, a sliding carriage disposed in said channel and serving to push trash particles falling into said channel to a trash removal suction point disposed along a travel path of the sliding carriage, and a traction mechanism disposed in said channel and coupled to the sliding carriage and disposed in said trash free clearance area laterally of trash distribution areas under said trash distribution area openings, wherein a recess is provided in the channel for the traction mechanism.

17. Trash removal system according to claim 16, wherein the sliding carriage is provided with coupling means applied in at the least one clearance area for coupling to the traction mechanism.

18. Trash removal system according to claim 16, wherein the at least one clearance area includes a clearance area on one side adjacent to the distribution area, in which clearance area the traction mechanism extends eccentrically to the sliding carriage.

19. Trash removal system according to claim 18, wherein the sliding carriage is provided with guiding devices for prevent the sliding carriage from tilting.

20. Trash removal system according to claim 16, wherein the sliding carriage is provided with guiding devices for prevent the sliding carriage from tilting.

* * * * *